US006523616B1

(12) United States Patent
Wallace

(10) Patent No.: US 6,523,616 B1
(45) Date of Patent: Feb. 25, 2003

(54) BUILDING FIRE EXTINGUISHING SYSTEM

(76) Inventor: Gary B. Wallace, 179 Lodgepole Rd., Kalama, WA (US) 98625

( * ) Notice: Subject to any disclaimer, the term of this patent is extended or adjusted under 35 U.S.C. 154(b) by 0 days.

(21) Appl. No.: 10/081,063

(22) Filed: Feb. 22, 2002

(51) Int. Cl.[7] ..... A62C 3/00

(52) U.S. Cl. ..... 169/70; 169/61; 169/9; 169/16; 239/208

(58) Field of Search ..... 169/56, 60, 61, 169/9, 16; 239/207, 208, 209

(56) References Cited

U.S. PATENT DOCUMENTS

| | | | | | |
|---|---|---|---|---|---|
| 1,162,572 | A | * | 11/1915 | Clark | 169/9 |
| 1,285,236 | A | * | 11/1918 | Kohler | 169/16 |
| 1,644,603 | A | * | 10/1927 | O'Neill | 169/16 |
| 1,831,880 | A | * | 11/1931 | Pierce | 169/16 |
| 1,921,452 | A | * | 8/1933 | Bronander | 169/56 |
| 2,337,710 | A | * | 12/1943 | Cowan | 169/16 |
| 2,776,861 | A | * | 1/1957 | Swenson | 239/208 |
| 4,091,876 | A | | 5/1978 | Valdatta | |
| 4,691,783 | A | | 9/1987 | Stern et al. | |
| 4,836,290 | A | | 6/1989 | Le Lande, Jr. | |
| 5,083,618 | A | | 1/1992 | Hayes | |
| 5,263,543 | A | | 11/1993 | Nigro | |
| 5,350,019 | A | | 9/1994 | Igarashi | |
| 5,692,571 | A | * | 12/1997 | Jackson | 169/16 |
| 5,732,511 | A | * | 3/1998 | Scott | 169/13 |
| 6,009,954 | A | * | 1/2000 | Phillips | 169/16 |

* cited by examiner

*Primary Examiner*—Christopher Kim

(57) ABSTRACT

A fire extinguishing and prevention system for dispersing a fire retardant substance for preventing a building from burning and for extinguishing a building already on fire. The fire extinguishing and prevention system includes a dispersal assembly coupled to an apex of a building, a plurality of remote dispersal units positioned around a peripheral area of the building, a plurality of heat sensor units positioned around the building, and a storage assembly for holding a fire retardant and extinguishing substance to be dispersed for preventing and extinguishing a fire.

11 Claims, 2 Drawing Sheets

10
50
40
20
40
22
4
2
62
64
62
64
60
38
36
32
30
36

22
26
42
42
24
24
44
46
44
20
40
46
25
25
27
27

BUILDING FIRE EXTINGUISHING SYSTEM

BACKGROUND OF THE INVENTION

1. Field of the Invention

The present invention relates to fire extinguishing and prevention systems and more particularly pertains to a new fire extinguishing and prevention system for dispersing a fire retardant substance onto and around a perimeter of a building to deny fuel to a fire, thus redirecting the fire away from the building or extinguishing the fire.

2. Description of the Prior Art

The use of fire extinguishing systems is known in the prior art. Known prior art includes U.S. Pat. No. 5,263,543; U.S. Pat. No. 4,836,290; U.S. Pat. No. 4,091,876; U.S. Pat. No. 4,691,783; U.S. Pat. No. 5,350,019; and U.S. Pat. No. 5,083,618.

While these devices fulfill their respective, particular objectives and requirements, the aforementioned patents do not disclose a new fire extinguishing and prevention system. The inventive device includes a dispersal assembly coupled to an apex of a building, a plurality of remote dispersal units positioned around a peripheral area of the building and surrounding grounds, a plurality of heat sensor units positioned around the building and surrounding grounds, and a storage assembly for holding a fire retardant and extinguishing substance to be dispersed for preventing and extinguishing a fire.

In these respects, the fire extinguishing and prevention system according to the present invention substantially departs from the conventional concepts and designs of the prior art, and in so doing provides an apparatus primarily developed for the purpose of dispersing a fire retardant substance for preventing a building from burning and for extinguishing a building already on fire.

SUMMARY OF THE INVENTION

In view of the foregoing disadvantages inherent in the known types of fire extinguishers now present in the prior art, the present invention provides a new fire extinguishing and prevention system construction wherein the same can be utilized for dispersing a fire retardant substance for preventing a building from burning and for extinguishing a building already on fire.

The general purpose of the present invention, which will be described subsequently in greater detail, is to provide a new fire extinguishing and prevention system apparatus and method which has many of the advantages of the fire extinguishers mentioned heretofore and many novel features that result in a new fire extinguishing and prevention system which is not anticipated, rendered obvious, suggested, or even implied by any of the prior art fire extinguishers, either alone or in any combination thereof.

To attain this, the present invention generally comprises a dispersal assembly coupled to an apex of a building, a plurality of remote dispersal units positioned around a peripheral area of the building, a plurality of heat sensor units positioned around the building, and a storage assembly for holding a fire retardant and extinguishing substance to be dispersed for preventing and extinguishing a fire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire extinguishing and prevention system apparatus and method which has many of the advantages of the fire extinguishers mentioned heretofore and many novel features that result in a new fire extinguishing and prevention system which is not anticipated, rendered obvious, suggested, or even implied by any of the prior art fire extinguishers, either alone or in any combination thereof.

It is another object of the present invention to provide a new fire extinguishing and prevention system that may be easily and efficiently manufactured and marketed.

It is a further object of the present invention to provide a new fire extinguishing and prevention system that is of a durable and reliable construction.

An even further object of the present invention is to provide a new fire extinguishing and prevention system which is susceptible of a low cost of manufacture with regard to both materials and labor, and which accordingly is then susceptible of low prices of sale to the consuming public, thereby making such fire extinguishing and prevention system economically available to the buying public.

Still yet another object of the present invention is to provide a new fire extinguishing and prevention system which provides in the apparatuses and methods of the prior art some of the advantages thereof, while simultaneously overcoming some of the disadvantages normally associated therewith.

Still another object of the present invention is to provide a new fire extinguishing and prevention system for dispersing a fire retardant substance for preventing a building from burning and for extinguishing a building already on fire.

Yet another object of the present invention is to provide a new fire extinguishing and prevention system which includes a dispersal assembly coupled to an apex of a building, a plurality of remote dispersal units positioned around a peripheral area of the building, a plurality of heat sensor units positioned around the building, and a storage assembly for holding a fire retardant and extinguishing substance to be dispersed for preventing and extinguishing a fire.

Still yet another object of the present invention is to provide a new fire extinguishing and prevention system that senses heat around a building and releases a fire extinguishing substance onto the building and the immediate area surrounding the building to protect the building from catching fire or continuing to burn.

Even still another object of the present invention is to provide a new fire extinguishing and prevention system that is controlled by a microcontroller for coordinating multiple sensors and distribution lines for selective release of the fire extinguishing substance, typically a foam, to an area of the building or area proximate the building determined at greatest risk for burning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
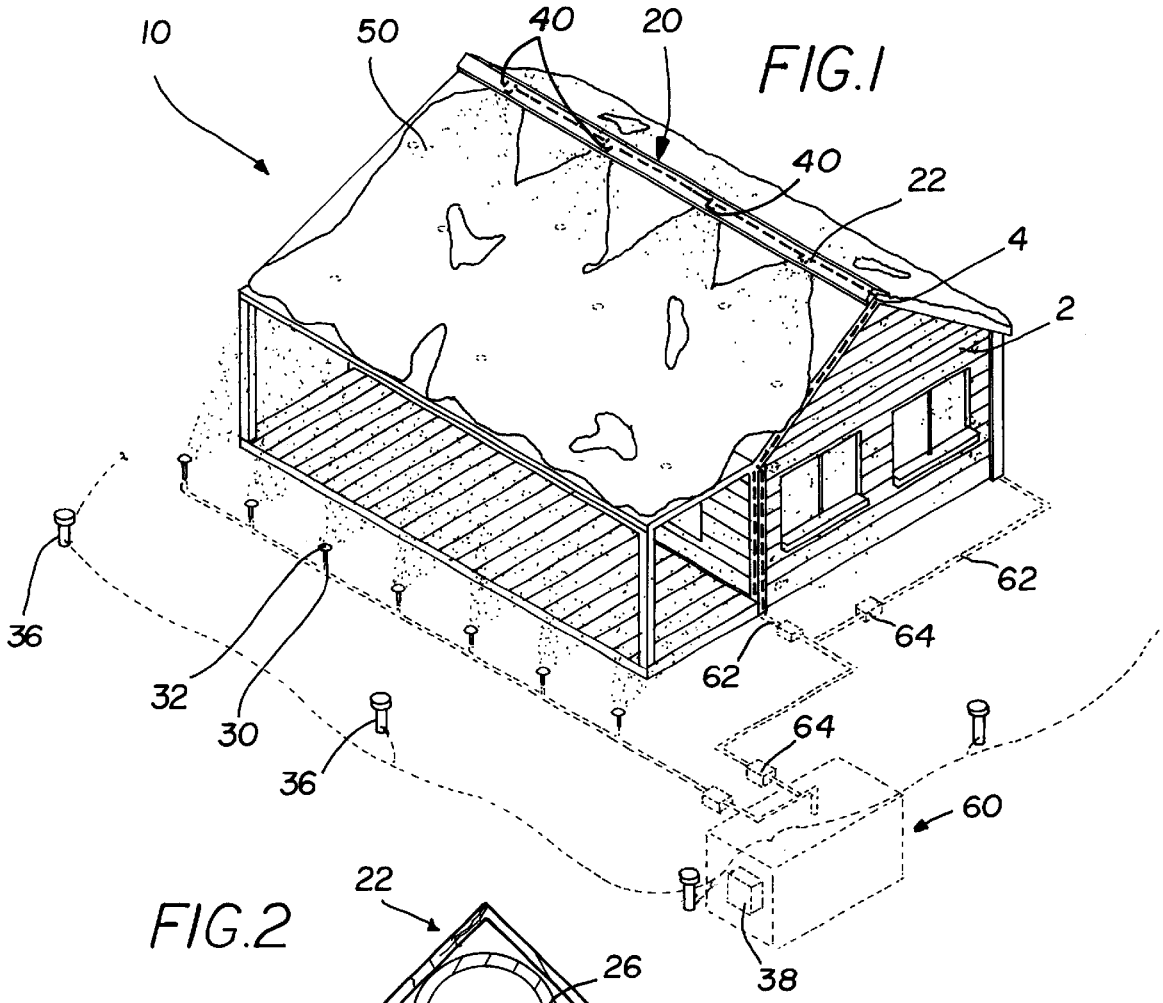
FIG. 1 is a perspective view of a new fire extinguishing and prevention system according to the present invention.
Figure 2:
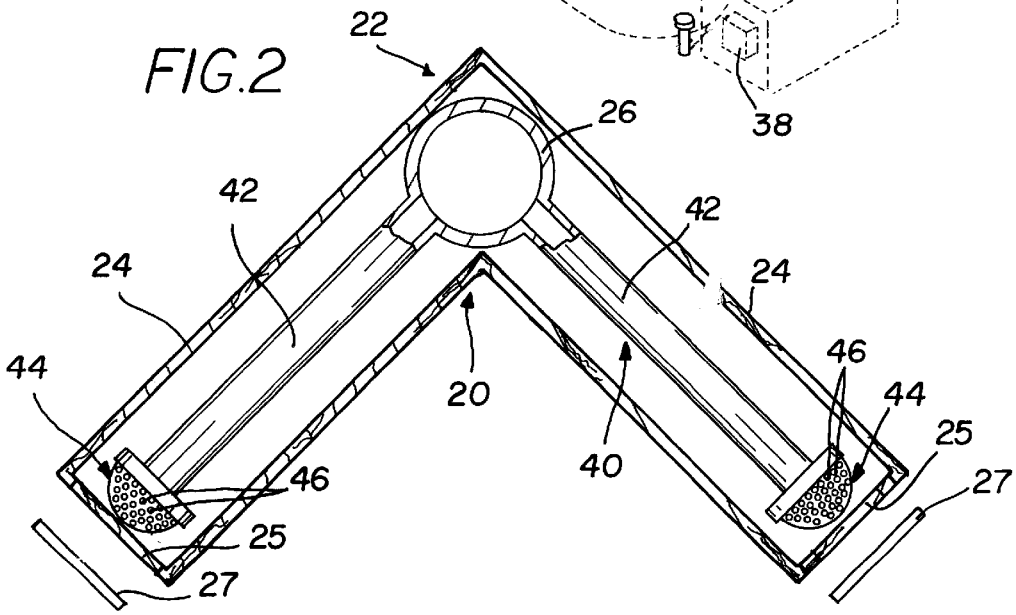
FIG. 2 is a cross-sectional view of the present invention taken along line 2—2 of FIG. 1.
Figure 3:
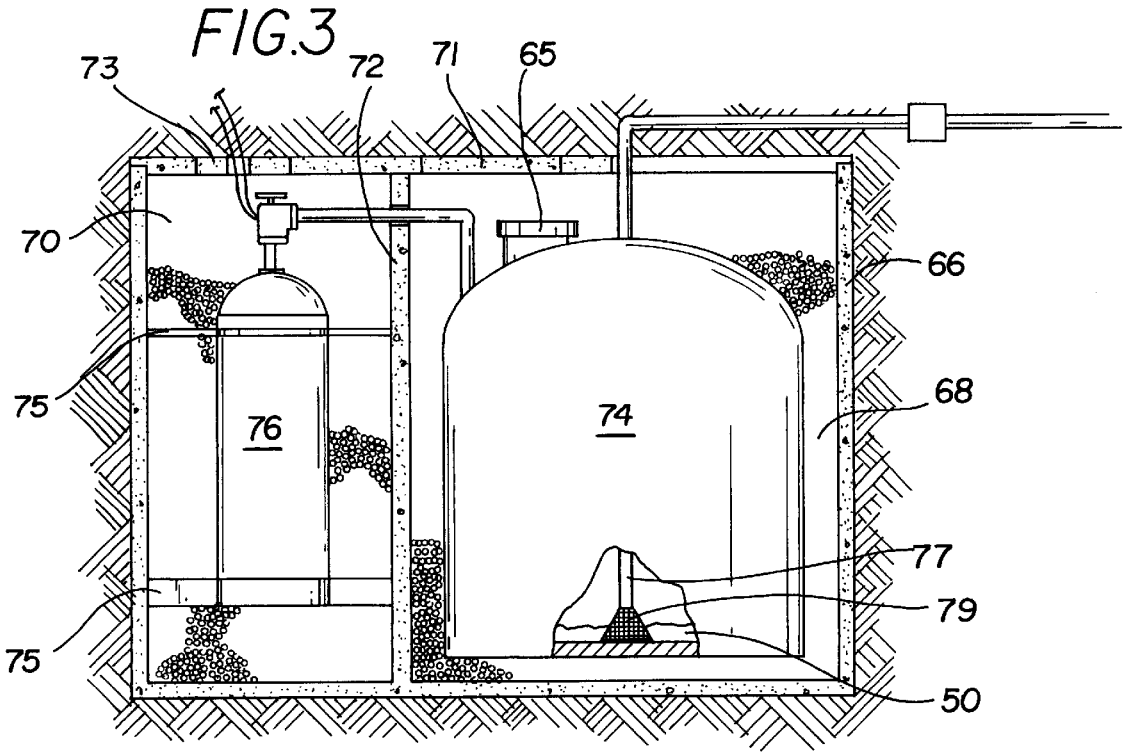
FIG. 3 is a cross-sectional view of the present invention taken along line 3—3 of FIG. 1.
Figure 4:
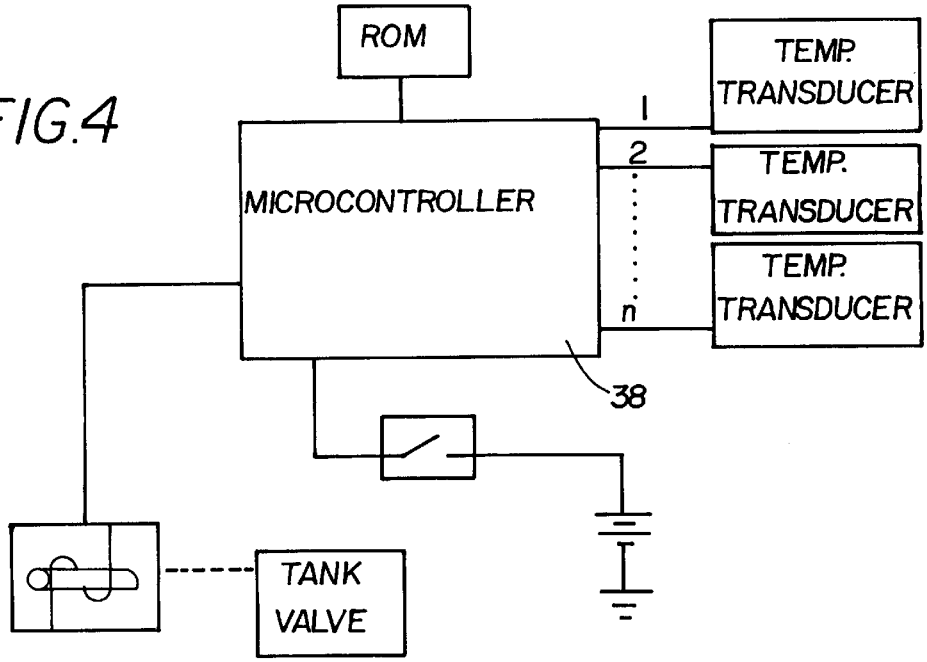
FIG. 4 is a schematic of the operational connection of the microcontroller of the present invention.

With reference now to the drawings, and in particular to FIGS. 1 through 4 thereof, a new fire extinguishing and prevention system embodying the principles and concepts of the present invention and generally designated by the reference numeral 10 will be described.

As best illustrated in FIGS. 1 through 4, the fire extinguishing and prevention system 10 generally comprises a roof dispersal assembly 20 designed for coupling to an apex 4 of a building 2. Typically, the building is of the A-frame style but the specific structure of the roof dispersal assembly can be coupled to any apex between two angled roof portions.

A plurality of remote ground dispersal assemblies 30 are positioned around a peripheral area of the building. Each remote ground dispersal assembly has a dispersal head 32 directed towards the building. Typically, the dispersal head can have a structure similar to the foam dispersal nozzles 40 described in greater detail below.

A plurality of heat sensor units 36 are positioned around the building. The heat sensor units is communicatively coupled to a microcontroller 38 that controls dispersal of a fire extinguishing substance 50 such as a fluid or foam chemical composition.

A storage assembly 60 is provided for holding and dispersing the fire extinguishing substance. The storage assembly is coupled to the roof dispersal assembly and the ground dispersal assemblies by a plurality of distribution lines 62 for distributing the fire extinguishing substance.

A plurality of check valves 64 are provided. Each check valve is associated with a respective one of the distribution lines for selectively permitting distribution of the fire extinguishing substance through the associated distribution line. Each of the check valves is in communication with the microcontroller so that the microcontroller controls distribution of the fire extinguishing substance through the distribution lines.

The roof dispersal assembly includes a roof housing 22 having a pair of flanges 24 extending outwardly from each other. The roof housing is positioned such that each flange is directed towards a respective side of the apex 4. The roof dispersal assembly also includes a central distribution conduit 26 in environmental communication with one of the distribution lines and a plurality of foam dispersal nozzles 40. The foam dispersal nozzles are positioned within the flanges of the housing and each of the foam dispersal nozzles extends outwardly from the central distribution conduit transverse to a longitudinal axis of the central distribution conduit. Each of the foam dispersal nozzles has a nozzle conduit 42 having a first end in environmental communication with the central distribution conduit. A dispersal screen 44 is coupled to a second end of the nozzle conduit opposite the first end. The dispersal screen is generally semi-spherical and includes a plurality of spaced apertures 46 extending therethrough. The foam dispersal nozzles 40 are positioned in spaced relationship to each other along a length of the central distribution conduit.

As stated above, the remote ground dispersal assemblies have similar structure to the foam dispersal nozzles except that the they are connected directly to one of the distribution lines and the dispersal head includes a dispersal screen that may include various patterns of apertures combined with solid portions of the dispersal screen to direct the fire extinguishing substance in a desired direction. Thus the remote ground dispersal assemblies can be aimed towards a particular desired section of the building.

The roof housing 22 includes a plurality of holes 25, each of the holes being positioned adjacent to an associated one of the foam dispersal nozzles. The roof dispersal assembly is designed to deliver the fire extinguishing substance out of the foam dispersal nozzle through the hole onto the building for extinguishing a fire.

A plurality of hole covers 27 are provided, each of the hole covers being detachably positioned within an associated one of the holes in the roof housing. Pressure from dispersal of the fire extinguishing substance detaches the hole covers to permit dispersal of the substance through the hole.

The storage assembly includes a storage housing 66 adapted for positioning underground proximate the building. The storage housing has a first chamber 68, a second chamber 70, and a dividing wall 72 extending between the first chamber and the second chamber. The storage assembly also includes a storage tank 74 positioned in the first chamber and a propellant tank 76 positioned in the second chamber. The propellant tank is in communication with the storage tank for actuating dispersal of the fire extinguishing substance from the storage tank. The propellant tank is also in operational communication with the microcontroller such that the propellant tank is actuatable by the microcontroller.

The first chamber includes a first chamber access lid 71 for permitting access to the storage tank and the second chamber includes a second chamber access lid 73 for permitting access to the propellant tank.

The second chamber includes a propellant tank harness 75 for holding the propellant tank in a static position in the second chamber.

The storage tank includes an exhaust pipe 77 positioned within the storage tank. The exhaust pipe has a first end in communication with one of the distribution lines. The exhaust pipe further has a filter screen 79 coupled to a second end of the exhaust pipe for preventing materials larger than a predetermined size from entering the exhaust pipe.

The storage tank including a refill port 65 for filling the storage tank with the fire extinguishing substance.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire extinguishing and preventative system comprising:

a building having an A-frame style roof;

a roof dispersal assembly coupled to an apex of said building;

a plurality of remote ground dispersal assemblies positioned around a peripheral area of said building, each remote ground dispersal assembly having a dispersal head directed towards a pre-determined area of said building and surrounding grounds;

a plurality of heat sensor units positioned around said building, said heat sensor units being communicatively coupled to a microcontroller;

a storage assembly for holding and dispersing a fire extinguishing substance, said storage assembly being coupled to said roof dispersal assembly and said ground dispersal assemblies by a plurality of distribution lines for distributing said fire extinguishing substance;

said microcontroller being for triggering dispersal of said fire extinguishing substance; and a plurality of check valves, each check valve being associated with a respective one of said distribution lines for selectively permitting distribution of said fire extinguishing substance through said associated distribution line, each of said check valves being in communication with said microcontroller whereby said microcontroller controls distribution of said fire extinguishing substance through said distribution lines;

said roof dispersal assembly including a roof housing having a pair of flanges extending outwardly from each other, said roof housing being positioned such that each flange is directed towards a respective side of the apex;

said roof dispersal assembly including a central distribution conduit in environmental communication with one of said distribution lines; and said roof dispersal assembly further having a plurality of foam dispersal nozzles positioned within said flanges of said housing, each of said foam dispersal nozzles extending outwardly from said central distribution conduit transverse to a longitudinal axis of said central distribution conduit and substantially parallel to a respective side of said roof of said building for dispersing said fire extinguishing substance onto said associated side of said roof of said building.

2. The fire extinguishing and preventative system of claim 1, further comprising:

each of said foam dispersal nozzles having a nozzle conduit, said nozzle conduit having a first end in environmental communication with said central distribution conduit; and a dispersal screen coupled to a second end of said nozzle conduit opposite said first end, said dispersal screen being generally semi-spherical and including a plurality of spaced apertures therethrough.

3. The fire extinguishing and preventative system of claim 1, further comprising:

said foam dispersal nozzles being positioned in spaced relationship to each other along each side of a length of said central distribution conduit; and said roof housing including a plurality of holes therein, each of said holes being positioned adjacent to an associated one of said foam dispersal nozzles such that said roof dispersal assembly is adapted to deliver said fire extinguishing substance from said foam dispersal nozzle through said hole onto the building for extinguishing a fire.

4. The fire extinguishing and preventative system of claim 1, further comprising:

said storage assembly including a storage housing adapted for positioning underground proximate said building, said storage housing having a first chamber, a second chamber, and a dividing wall extending between said first chamber and said second chamber;

said storage assembly including a storage tank positioned in said first chamber; and said storage assembly including a propellant tank positioned in said second chamber, said propellant tank being in communication with said storage tank for actuating dispersal of said fire extinguishing substance from said storage tank.

5. The fire extinguishing and preventative system of claim 4, further comprising:

said first chamber including a first chamber access lid for permitting access to said storage tank.

6. The fire extinguishing and preventative system of claim 4, further comprising:

said second chamber including a second chamber access lid for permitting access to said propellant tank.

7. The fire extinguishing and preventative system of claim 4, further comprising:

said second chamber including a propellant tank harness for holding said propellant tank in a static position in said second chamber.

8. The fire extinguishing and preventative system of claim 4, further comprising:

said storage tank including an exhaust pipe positioned within said storage tank, said exhaust pipe having a first end in communication with one of said distribution lines, said exhaust pipe further having a filter screen coupled to a second end of said exhaust pipe for preventing materials larger than a predetermined size from entering said exhaust pipe.

9. The fire extinguishing and preventative system of claim 4, further comprising:

said storage tank including a refill port for filling said storage tank with said fire extinguishing substance.

10. The fire extinguishing and preventative system of claim 4, further comprising:

said propellant tank being in operational communication with said microcontroller such that said propellant tank is actuatable by said microcontroller.

11. A fire extinguishing and preventative system comprising:

a building having a roof;

a roof dispersal assembly coupled to an apex of said building;

a plurality of remote ground dispersal assemblies positioned around a peripheral area of said building, each remote ground dispersal assembly having a dispersal head directed towards said building;

a plurality of heat sensor units positioned around said building, said heat sensor units being communicatively coupled to a microcontroller;

a storage assembly for holding and dispersing a fire extinguishing substance, said storage assembly being coupled to said roof dispersal assembly and said ground dispersal assemblies by a plurality of distribution lines for distributing said fire extinguishing substance;

said microcontroller being for triggering dispersal of said fire extinguishing substance;

a plurality of check valves, each check valve being associated with a respective one of said distribution lines for selectively permitting distribution of said fire extinguishing substance through said associated distribution line, each of said check valves being in communication with said microcontroller whereby said microcontroller controls distribution of said fire extinguishing substance through said distribution lines;

said roof dispersal assembly including a roof housing having a pair of flanges extending outwardly from each other, said roof housing being positioned such that each flange is directed towards a respective side of the apex;

said roof dispersal assembly including a central distribution conduit in environmental communication with one of said distribution lines;

said roof dispersal assembly further having a plurality of foam dispersal nozzles positioned within said flanges of said housing, each of said foam dispersal nozzles extending outwardly from said central distribution conduit transverse to a longitudinal axis of said central distribution conduit and substantially parallel to a respective side of said roof of said building for dispersing said fire extinguishing substance onto said associated side of said roof of said building;

each of said foam dispersal nozzles having a nozzle conduit, said nozzle conduit having a first end in environmental communication with said central distribution conduit;

a dispersal screen coupled to a second end of said nozzle conduit opposite said first end, said dispersal screen being generally semi-spherical and including a plurality of spaced apertures therethrough;

said foam dispersal nozzles being positioned in spaced relationship to each other along a length of said central distribution conduit;

said roof housing including a plurality of holes therein, each of said holes being positioned adjacent to an associated one of said foam dispersal nozzles such that said roof dispersal assembly is adapted to deliver said fire extinguishing substance from said foam dispersal nozzle through said hole onto the building for extinguishing a fire;

said storage assembly including a storage housing adapted for positioning underground proximate said building, said storage housing having a first chamber, a second chamber, and a dividing wall extending between said first chamber and said second chamber;

said storage assembly including a storage tank positioned in said first chamber;

said storage assembly including a propellant tank positioned in said second chamber, said propellant tank being in communication with said storage tank for actuating dispersal of said fire extinguishing substance from said storage tank;

said first chamber including a first chamber access lid for permitting access to said storage tank;

said second chamber including a second chamber access lid for permitting access to said propellant tank;

said second chamber including a propellant tank harness for holding said propellant tank in a static position in said second chamber;

said storage tank including an exhaust pipe positioned within said storage tank, said exhaust pipe having a first end in communication with one of said distribution lines, said exhaust pipe further having a filter screen coupled to a second end of said exhaust pipe for preventing materials larger than a predetermined size from entering said exhaust pipe;

said storage tank including a refill port for filling said storage tank with said fire extinguishing substance; and said propellant tank being in operational communication with said microcontroller such that said propellant tank is actuatable by said microcontroller.

* * * * *